US005892191A

United States Patent [19]

Hagiya et al.

[11] Patent Number: 5,892,191

[45] **Date of Patent: *Apr. 6, 1999**

[54] SHEET-LIKE SWITCH WITH NONOVERLAPPING CONDUCTIVE PATTERNS

[75] Inventors: Ryuichi Hagiya; Satoru Takemori; Naoki Yamada, all of Fukushima-ken, Japan

[73] Assignee: Alps Electric Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 717,654

[22] Filed: Sep. 24, 1996

[30] Foreign Application Priority Data

Sep. 29, 1995 [JP] Japan ..... 7-277082

[51] Int. Cl.[6] ..... H01H 9/26

[52] U.S. Cl. ..... 200/5 A

[58] Field of Search ..... 200/5 A, 5 R, 200/512, 513, 514, 515, 516, 517; 338/279

[56] References Cited

U.S. PATENT DOCUMENTS 4,485,279 11/1984 Nakamura ..... 200/5 A
4,994,634 2/1991 Tanji et al. ..... 200/5 A
5,001,308 3/1991 Mori ..... 200/5 A
5,536,682 7/1996 Kayama ..... 437/195

FOREIGN PATENT DOCUMENTS 3-176921 (A) 7/1991 Japan .

*Primary Examiner*—Edward H. Tso
*Attorney, Agent, or Firm*—Brinks Hofer Gilson & Lione

[57] ABSTRACT

A sheet-like switch is disclosed in which the migration of silver can be prevented without requiring the provision of an overcoat. An upper electrode sheet is formed by disposing upper contacts and upper conductive patterns electrically connected to each other on an insulating sheet. A lower electrode sheet is formed by disposing lower contacts and lower conductive patterns electrically connected to each other on an insulating sheet. The upper and lower electrode sheets are stacked on each other across a spacer film provided with a hole. The upper and lower contacts are placed to opposedly face each other within the hole, and the upper and lower conductive patterns located within the hole are extended to the exterior in different directions, so that the upper and lower conductive patterns positioned on the peripheral portion of the hole can be prevented from overlapping each other across the spacer film in the upward and downward direction. Further, the length along the peripheral portion of the hole defined between the upper and lower conductive patterns positioned on the peripheral portion may preferably be 0.5 mm or greater.

5 Claims, 4 Drawing Sheets

SHEET-LIKE SWITCH WITH NONOVERLAPPING CONDUCTIVE PATTERNS

BACKGROUND OF THE INVENTION

1. Field of the Invention

The present invention relates to a sheet-like switch provided with a plurality of switch devices.

2. Description of the Related Art

A typical sheet-like switch of a known type is constructed as shown in FIG. 5. Namely, an upper electrode sheet 1 is formed by printing predetermined upper contacts 2 and upper conductive patterns 3, both of which are made from a silver paste, on an insulating sheet, such as polyester film or the like. An overcoat 4 formed from resist ink, carbon ink or the like, is further disposed on the sheet 1 to cover the conductive patterns 3 except for the upper contacts 2 positioned at the ends of the respective patterns 3. A spacer film 5, formed of polyester film or the like, is provided with holes 5*a* in the predetermined positions. A lower electrode sheet 6, as well as the upper electrode sheet 1, is formed by printing lower contacts 7 and lower conductive patterns 8, which are made from a silver paste, on polyester film or the like. An overcoat 9 similar to the overcoat 4 is disposed on the sheet 6 to cover the lower conductive patterns 8 except for the lower contacts 7 located at the ends of the respective patterns 8.

With this construction, the upper and lower electrode sheets 1 and 6 are, as illustrated in FIG. 6, stacked on each other across the spacer film 5, and the upper and lower contacts 2 and 7 of the upper and lower conductive patterns 3 and 8, respectively, are located to opposedly face the holes 5*a* formed in the spacer film 5. In this manner, the sheet-like switch provided with a plurality of switch devices is constructed.

In the sheet-like switch of the above known type, as shown in FIG. 7, the upper and lower conductive patterns 3 and 8 located within the hole 5*a* of the spacer film 5 are extended to the exterior in the same direction and overlaid on each other across the spacer film in the upward and downward direction. Further, the thickness of the spacer film 5 is as thin as approximately 75 $\mu$m, so that the upper and lower conductive patterns 3 and 8 are positioned in very close proximity to each other.

Hence, as illustrated in FIG. 8, the absence of the overcoats 4 and 9 causes silver to precipitate from the upper and lower conductive patterns 3 and 8 placed in proximity to each other in the hole 5*a* of the spacer film 5. This further encourages the generation of a silver-migrating portion 10 using the inner wall of the peripheral portion 5*b* of the hole 5*a* as a medium, which may establish an electrical connection between the conductive patterns 3 and 8. The provision of the overcoats 4 and 9 thus serves to prevent this electrical connection.

The switch constructed as described above is operable as follows. The upper contact 2 on the upper electrode sheet 1 is pressed by a finger or the like. This deflects the sheet 1 to connect the upper and lower contacts 2 and 7 overlaid in the holes 5*a* across the spacer film 5, thereby turning on the switch. On the other hand, the upper contact 2 is released to separate from the lower contact 7, thereby turning off the switch.

However, as described above, the sheet-like switch of the above conventional type is constructed in such a manner that the upper and lower conductive patterns 3 and 8 are extended to the exterior in the same direction and overlaid on each other across the spacer film in the upward and downward direction. As the switch is becoming thinner, the upper and lower conductive patterns 3 and 8 are located in closer proximity to each other, which encourages the generation of migration, which may establish an electrical connection between the conductive patterns 3 and 8.

In order to take measures against this migration, the provision of the overcoats 4 and 9 on the upper and lower conductive patterns 3 and 8, respectively, is conventionally required. This disadvantageously increases the manufacturing processes and cost.

SUMMARY OF THE INVENTION

Accordingly, it is an object of the present invention to provide a sheet-like switch in which an improvement is made in the arrangement of upper and lower conductive patterns so as to prevent the generation of migration without requiring the provision of overcoats, free from the problems inherent in the known art.

In order to achieve the above object, according to the present invention, there is provided a sheet-like switch comprising: an upper electrode sheet having an upper contact and an upper conductive pattern electrically connected to the upper contact; a lower electrode sheet having a lower contact and a lower conductive pattern electrically connected to the lower contact; and a spacer film having a hole across which the upper and lower electrode sheets are stacked on each other, wherein the upper and lower contacts are located to opposedly face each other within the hole of the spacer film, and the upper and lower conductive patterns are extended to the exterior in different directions, so that the upper and lower conductive patterns positioned on the peripheral portion of the hole are prevented from overlapping each other across the spacer film in the upward and downward direction.

Further, in the above-described sheet-like switch, the length along the peripheral portion of the hole defined between the upper and lower conductive patterns positioned on the peripheral portion may be set to be 0.5 mm or greater.

Moreover, in the above-described sheet-like switch, a spacer may be disposed around the upper contact and/or the lower contact and in the vicinity of the hole of the spacer film.

The migration of silver is generated between a positive electrode and a negative electrode, but not between conductive patterns at the same potential. The occurrence of the migration can be inhibited to a greater degree if the spacing between the conductive patterns at a different potential is larger. The experiment reveals that a spacing of 0.5 mm or larger can ensure environmental performance that can sufficiently endure the migration. The present invention is based on the aforedescribed conditions and offers the advantage of preventing the migration of silver without requiring the provision of overcoats by use of an improvement in the arrangement of the upper and lower conductive patterns.

DESCRIPTION OF THE PREFERRED EMBODIMENT

An embodiment of a sheet-like switch according to the present invention will now be described with reference to FIGS. 1 through 4.

Figure 1:
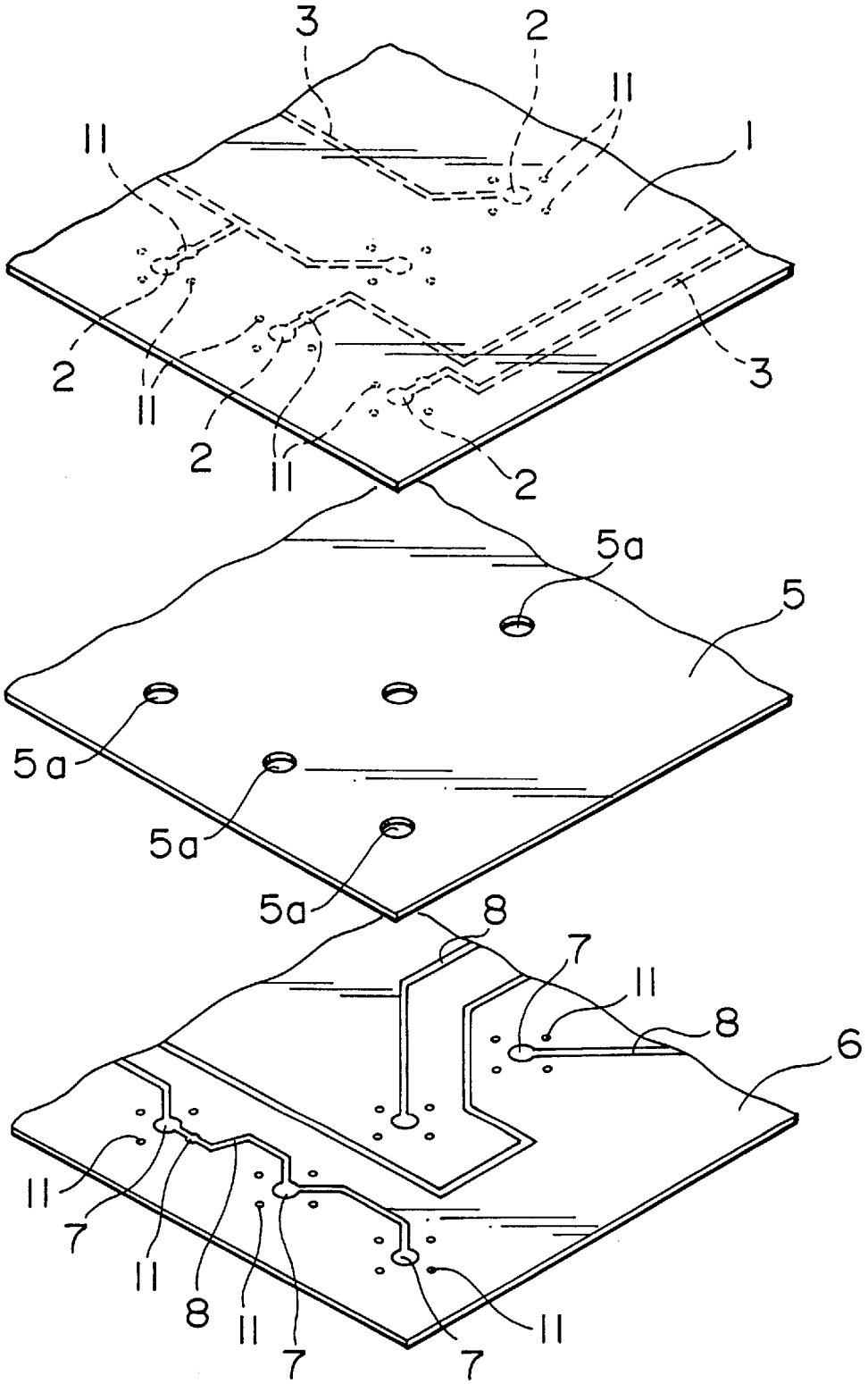
FIG. 1 is an exploded perspective view of a sheet-like switch according to the present invention.

Referring to FIG. 1, an upper electrode sheet 1 is constructed by printing a plurality of upper conductive patterns 3 on an insulating sheet, such as polyester film or the like, the conductive patterns 3 being formed of a single layer consisting of silver or a mixture of silver and carbon, or a composite layer consisting of silver and carbon. An upper contact 2 is formed at the end of each of upper conductive patterns 3, both of the elements 2 and 3 being made from the same material. Moreover, spacers 11, which are made from the same material as the patterns 3 and produced together, are disposed in the four positions around each contact 2.

A spacer film 5, formed of polyester film or the like, is provided with a plurality of holes 5*a* in the positions corresponding to the respective contacts 2. A lower electrode sheet 6, as well as the upper electrode sheet 1, is constructed by printing lower electrode patterns 8 on an insulating sheet, the patterns 8 being formed of a single layer consisting of silver, a single layer formed of a mixture of silver and carbon, or a composite layer formed of silver and carbon. A lower contact 7 is also formed at the end of each of the lower conductive patterns 8, and spacers 11 are disposed in the four positions around each contact 7.

Figure 2:
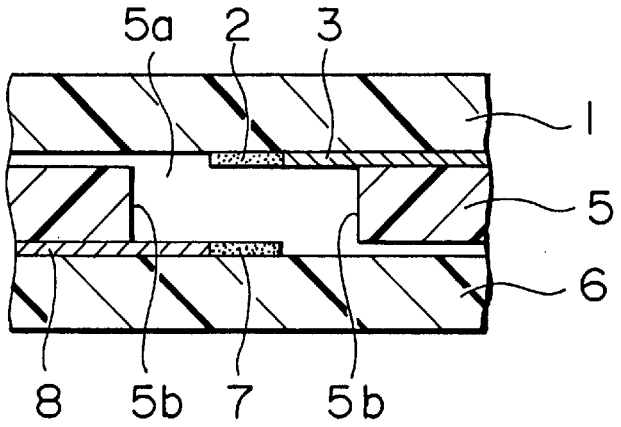
FIG. 2 is a sectional view of a switch device of a sheet-like switch according to the present invention.

With this construction, as illustrated in FIG. 2, the upper and lower electrode sheets 1 and 6 are stacked on each other across the spacer film 5, and the upper and lower contacts 2 and 7 are placed to opposedly face each other in the corresponding holes 5*a* of the spacer film 5. In this fashion, the sheet-like switch having a plurality of switch devices is produced.

Figure 3:
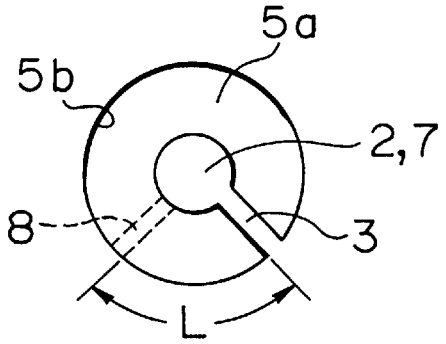
FIG. 3 illustrates the switch device shown in FIG. 2.

In this invention, as shown in FIG. 3, the upper and lower conductive patterns 3 and 8 located within the holes 5*a* of the spacer film 5 are extended to the exterior in different directions without overlapping each other across the spacer film 5 in the upward and downward directions. The length L along the peripheral portion 5*b* of the hole 5*a* defined between the upper and lower conductive patterns 3 and 8 positioned on the peripheral portion 5*b* is set to be 0.5 mm or greater.

Figure 4:
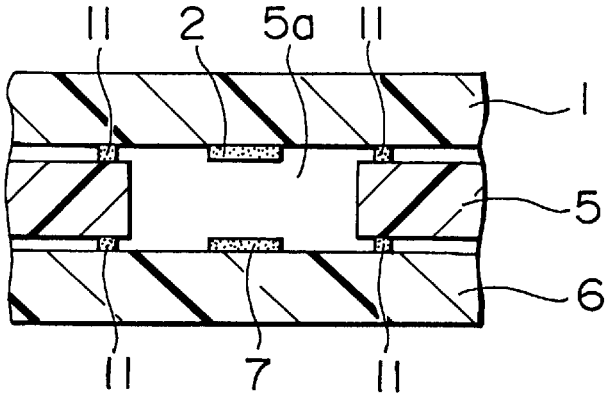
FIG. 4 is a cross sectional view taken along the spacers of the switch device shown in FIG. 2.
Figure 5:
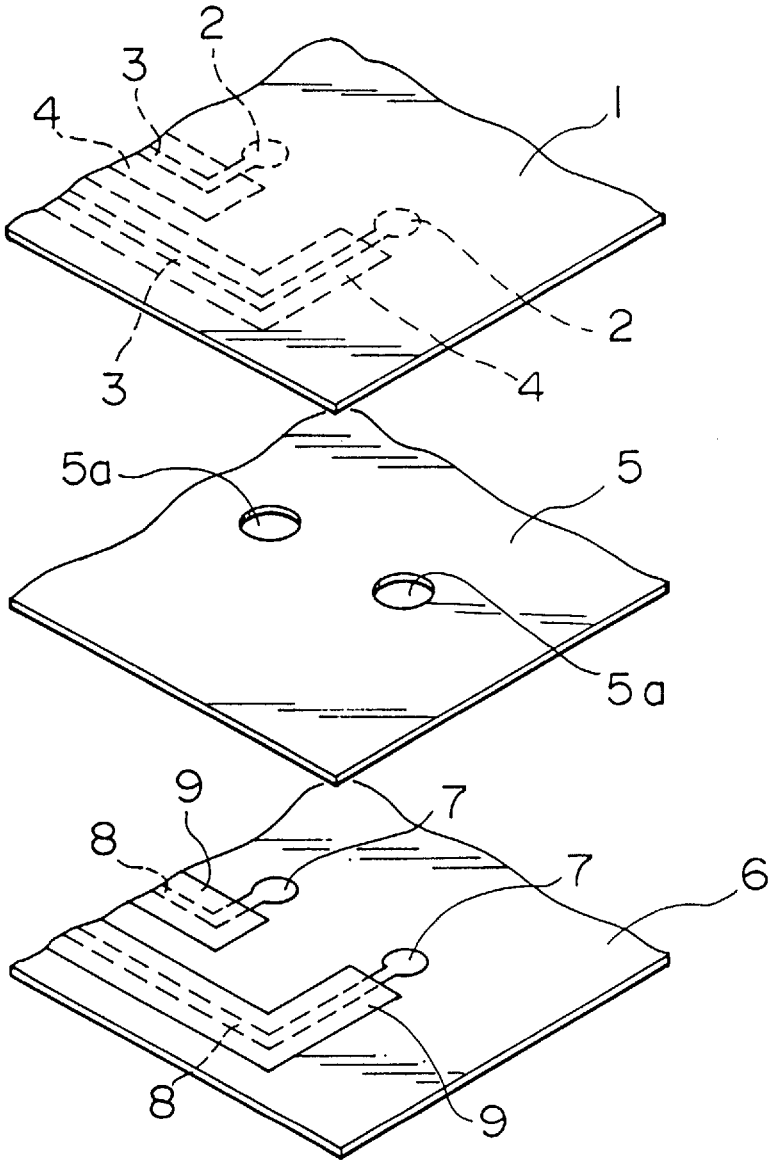
FIG. 5 PRIOR ART
FIG. 5 is an exploded perspective view of a typical sheet-like switch of a known type.
Figure 6:
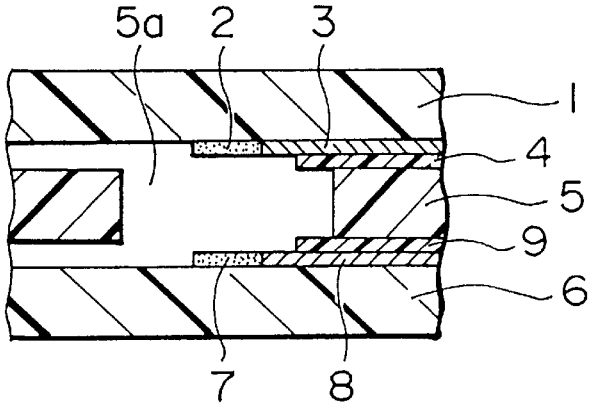
FIG. 6 PRIOR ART
FIG. 6 is a sectional view of a switch device of a typical sheet-like switch of a known type.
Figure 7:
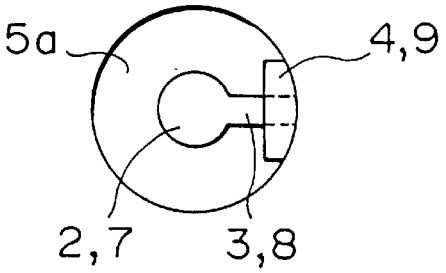
FIG. 7 PRIOR ART
FIG. 7 illustrates the switch device shown in FIG. 6.
Figure 8:
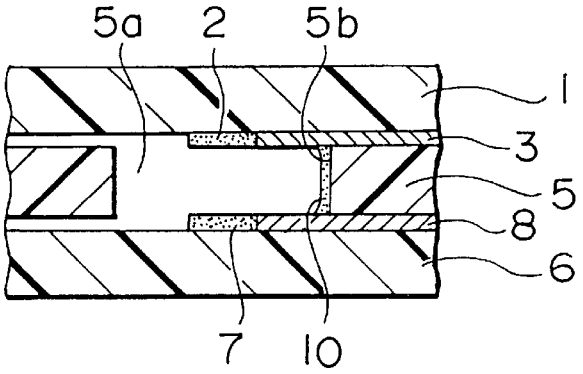
FIG. 8 PRIOR ART
FIG. 8 is a sectional view illustrating the migration of silver generated in the switch device shown in FIG. 6.

FIG. 4 is a cross sectional view taken along the spacers 11 of the above-described switch device. The spacers 11 function to compensate for the problems caused by the decreased thickness of the upper and lower electrode sheets 1 and 6 and the spacer film 5 (all the components having a thickness of 75 $\mu$m or smaller), for example, the problems of an inadequate voltage resistance between the upper and lower contacts 2 and 7 and a failure in recovering the contacts 2 and 7, thereby ensuring a predetermined gap between the contacts 2 and 7. The thickness of all of the upper and lower contacts 2 and 7 and the spacers 11 ranges from 5 to 25 $\mu$m.

As will be clearly understood from the foregoing description, the present invention offers the following advantages.

The upper and lower electrode sheets are stacked on each other across a spacer film provided with holes, and then, the upper and lower contacts are located to opposedly face each other in the corresponding holes. The upper and lower conductive patterns located in the hole are thus positioned to be extended to the exterior without overlapping each other across the spacer film in the upward and downward direction. With this arrangement, the sheet-like switch of the present invention is dominant over the known type because the occurrence of the migration of silver between the upper and lower conductive patterns located in the hole can be reduced. This eliminates the need for the provision of overcoats formed on the upper and lower conductive patterns, respectively, thereby decreasing the manufacturing processes and cost.

The length along the peripheral portion of the hole defined between the upper and lower conductive patterns positioned on the peripheral portion is set to be 0.5 mm or greater, thereby guaranteeing the environmental performance of the switch sufficiently to resist the migration.

Further, the spacers are provided around the upper contacts and/or the lower contacts and in the vicinity of the holes, thus compensating for the problems caused by the decreased thickness of the sheet-like switch, such as an inadequate voltage resistance between the upper and lower contacts and a failure in recovering the contacts.

What is claimed is:

1. A sheet-like switch comprising:

an upper electrode sheet having a plurality of upper contacts and plurality of upper conductive patterns electrically connected to said upper contacts;

a lower electrode sheet having a plurality of lower contacts and a plurality of lower conductive patterns electrically connected to said lower contacts; and a spacer film having a plurality of holes, said spacer film being located between said upper and lower electrode sheets, each of said plurality of holes having a peripheral edge, wherein each of said upper contacts and an associated one of said lower contacts are located to opposedly face each other within an associated hole of said spacer film, and wherein all of said upper conductive patterns extend from respective upper contacts in different directions relative to associated lower conductive patterns respectively extending from associated lower contacts such that the upper conductive pattern of each associated pair of said upper and lower conductive patterns contacts a first portion of the peripheral edge of said associated hole which is displaced along said peripheral edge from a second portion contacted by the lower conductive pattern of said associated pair of upper and lower contact patterns.

2. A sheet-like switch according to claim 1, wherein a length along the peripheral portion of said hole defined between said upper and lower conductive patterns positioned on the peripheral portion is 0.5 mm or greater.

3. A sheet-like switch according to claim 1, wherein a spacer is disposed around at least one of said upper contact and said lower contact in the vicinity of the hole of said spacer film.

4. A sheet-like switch according to claim 2, wherein a spacer is disposed around at least one of said upper contact and said lower contact and in the vicinity of the hole of said spacer film.

5. A sheet-like switch according to claim 1, wherein neither of said upper and lower conductive patterns are covered by an overcoat layer.

* * * * *